US007896753B2

(12) United States Patent
Boyd et al.

(10) Patent No.: US 7,896,753 B2
(45) Date of Patent: Mar. 1, 2011

(54) WRAPPING ELEMENT FOR A GOLF CLUB

(75) Inventors: Robert Boyd, Euless, TX (US); Mark J. Perry, Hilliard, OH (US); John T. Stites, Weatherford, TX (US)

(73) Assignee: Nike, Inc., Beaverton, OR (US)

( * ) Notice: Subject to any disclaimer, the term of this patent is extended or adjusted under 35 U.S.C. 154(b) by 119 days.

(21) Appl. No.: 12/262,236

(22) Filed: Oct. 31, 2008

(65) Prior Publication Data

US 2010/0113176 A1 May 6, 2010

(51) Int. Cl.
*A63B 53/04* (2006.01)
*A63B 53/06* (2006.01)

(52) U.S. Cl. ..... 473/226; 473/256; 473/334

(58) Field of Classification Search ..... 473/324–350
See application file for complete search history.

(56) References Cited

U.S. PATENT DOCUMENTS

| | | | | | |
|---|---|---|---|---|---|
| 699,624 | A | * | 5/1902 | Kempshall | 473/329 |
| 726,885 | A | * | 5/1903 | Dunn | 473/329 |
| 890,836 | A | * | 6/1908 | Beale | 473/329 |
| 1,939,414 | A | | 12/1933 | Sametz | |
| 2,008,944 | A | | 7/1935 | Carmichael | |
| 2,620,186 | A | * | 12/1952 | Beeaff, Jr. | 473/231 |
| 2,681,225 | A | | 5/1954 | De Vries | |
| 2,715,026 | A | | 8/1955 | Cadman | |
| 2,912,245 | A | * | 11/1959 | Gardner et al. | 473/563 |
| 2,950,919 | A | | 8/1960 | Cadman | |
| D198,136 | S | | 5/1964 | Harrigan | |
| 3,133,735 | A | | 5/1964 | Greenshields | |
| 3,398,961 | A | * | 8/1968 | Higdon | 473/242 |
| 3,912,277 | A | | 10/1975 | Pelz | |
| 4,213,614 | A | * | 7/1980 | Philippi | 473/231 |
| 4,842,280 | A | * | 6/1989 | Hilton | 473/231 |
| 5,076,585 | A | * | 12/1991 | Bouquet | 473/343 |
| 5,195,568 | A | | 3/1993 | Cirone | |
| 5,230,512 | A | * | 7/1993 | Tattershall | 473/220 |
| 5,294,127 | A | * | 3/1994 | Keelan | 473/256 |
| 5,299,807 | A | * | 4/1994 | Hutin | 473/329 |
| 5,316,298 | A | * | 5/1994 | Hutin et al. | 473/332 |
| 5,403,009 | A | | 4/1995 | Gleason, Jr. | |
| 5,441,268 | A | | 8/1995 | Shier | |
| 5,492,327 | A | * | 2/1996 | Biafore, Jr. | 473/332 |
| 5,542,675 | A | * | 8/1996 | Micciche et al. | 473/329 |
| 5,616,088 | A | * | 4/1997 | Aizawa et al. | 473/341 |

(Continued)

FOREIGN PATENT DOCUMENTS

FR 2672226 A1 * 8/1992

(Continued)

OTHER PUBLICATIONS

PCT/US2009/062684, International Search Report and Written Opinion, Dec. 23, 2009.

*Primary Examiner*—Alvin A Hunter
(74) *Attorney, Agent, or Firm*—Banner & Witcoff, Ltd.

(57) ABSTRACT

Wood-type golf club heads (e.g., drivers, fairway woods, wood-type hybrid clubs, or the like) include: (a) a ball striking face; (b) a club head body engaged or integrally formed with the ball striking face, wherein the club head body includes a removable wrapping element proximal to the ball striking face.

32 Claims, 16 Drawing Sheets

U.S. PATENT DOCUMENTS

| | | | | | |
|---|---|---|---|---|---|
| 5,669,826 | A | * | 9/1997 | Chang et al. | 473/332 |
| 5,692,972 | A | * | 12/1997 | Langslet | 473/332 |
| 5,720,674 | A | * | 2/1998 | Galy | 473/345 |
| 5,899,819 | A | * | 5/1999 | Mount et al. | 473/329 |
| 5,941,293 | A | | 8/1999 | Serpa | |
| 5,944,081 | A | | 8/1999 | Aldcroft et al. | |
| 5,971,867 | A | * | 10/1999 | Galy | 473/345 |
| 6,042,486 | A | * | 3/2000 | Gallagher | 473/329 |
| 6,065,516 | A | | 5/2000 | Chang | |
| 6,165,081 | A | * | 12/2000 | Chou | 473/329 |
| 6,217,461 | B1 | | 4/2001 | Galy | |
| 6,419,591 | B1 | | 7/2002 | Addeo et al. | |
| 6,443,851 | B1 | * | 9/2002 | Liberatore | 473/256 |
| 6,461,249 | B2 | * | 10/2002 | Liberatore | 473/256 |
| 6,478,690 | B2 | * | 11/2002 | Helmstetter et al. | 473/324 |
| 6,652,387 | B2 | * | 11/2003 | Liberatore | 473/256 |
| 6,672,975 | B1 | * | 1/2004 | Galloway | 473/342 |
| 6,716,111 | B2 | * | 4/2004 | Liberatore | 473/256 |
| 6,890,267 | B2 | * | 5/2005 | Mahaffey et al. | 473/256 |
| 7,226,366 | B2 | * | 6/2007 | Galloway | 473/342 |
| 7,422,528 | B2 | * | 9/2008 | Gibbs et al. | 473/329 |
| 7,530,902 | B2 | * | 5/2009 | Nakamura | 473/334 |
| 7,588,503 | B2 | * | 9/2009 | Roach et al. | 473/332 |
| 2002/0183134 | A1 | * | 12/2002 | Allen et al. | 473/329 |
| 2003/0054901 | A1 | * | 3/2003 | Sun | 473/342 |
| 2003/0220154 | A1 | | 11/2003 | Anelli | |
| 2003/0232659 | A1 | | 12/2003 | Mahaffey et al. | |
| 2004/0261924 | A1 | | 12/2004 | Bradshaw | |
| 2006/0293120 | A1 | | 12/2006 | Cackett et al. | |

FOREIGN PATENT DOCUMENTS

| | | | | |
|---|---|---|---|---|
| JP | 05057036 | A | * | 3/1993 |
| JP | 07163688 | A | * | 6/1995 |
| JP | 07299165 | A | * | 11/1995 |
| JP | 08206258 | A | * | 8/1996 |
| JP | 10108927 | A | * | 4/1998 |
| JP | 10192453 | A | * | 7/1998 |
| JP | 10248968 | A | * | 9/1998 |
| JP | 2000014841 | A | * | 1/2000 |
| JP | 2000024146 | A | * | 1/2000 |
| JP | 2000176056 | A | * | 6/2000 |
| JP | 2001062013 | A | * | 3/2001 |
| JP | 2002052099 | A | * | 2/2002 |
| JP | 2002320691 | A | * | 11/2002 |
| JP | 2003062135 | A | * | 3/2003 |
| JP | 2003093554 | A | * | 4/2003 |
| JP | 2003117030 | A | * | 4/2003 |
| JP | 2003260153 | A | * | 9/2003 |
| JP | 2004216131 | A | * | 8/2004 |
| JP | 2004236985 | A | * | 8/2004 |
| JP | 2004267286 | A | * | 9/2004 |
| JP | 2004351096 | A | * | 12/2004 |
| JP | 2006288882 | A | * | 10/2006 |
| WO | WO 9920358 | A1 | * | 4/1999 |

* cited by examiner

WRAPPING ELEMENT FOR A GOLF CLUB

FIELD OF THE INVENTION

The present invention relates to golf clubs. Particular example aspects of this invention relate to golf clubs having a wrapping element.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

While the industry has witnessed dramatic changes and improvements to golf equipment in recent years, some players continue to experience difficulties in reliably hitting a golf ball in an intended and desired direction and/or with an intended and desired flight path. Accordingly, there is room in the art for further advances in golf club technology.

SUMMARY

The following presents a general summary of aspects of the disclosure in order to provide a basic understanding of the disclosure and various aspects of it. This summary is not intended to limit the scope of the disclosure in any way, but it simply provides a general overview and context for the more detailed description that follows.

Aspects of this disclosure relate to a wood-type golf club head, comprising: a ball striking face; a club head body coupled to or integrally formed with the ball striking face, the club head body including a groove extending at least around the perimeter of the club head body; and a wrapping element comprising a first portion for extending around the perimeter of the club head body adjacent to the ball striking face and engaging the groove in the golf club head body.

Other aspects relate to a wood-type golf club, comprising: a club head comprising: a ball striking face; a club head body coupled to or integrally formed with the ball striking face, the club head body including a groove extending at least around the perimeter of the club head body; a wrapping element comprising a first portion for extending around the perimeter of the club head body adjacent to the ball striking face and engaging the groove in the golf club head body; and a shaft member engaged with the club head.

Other aspects include a removable wrapping element for use with a golf club head including a ball striking face and a golf club head body, the removable wrapping element comprising: a first portion configured to extend around the perimeter of the golf club head body adjacent to the ball striking face and configured to be removably attached to the golf club head body via a groove.

Other aspects include a method, comprising: providing a club head including a ball striking face and a club head body engaged or integrally formed with the ball striking face, the club head body including a groove; and attaching a wrapping element to the club head.

BRIEF DESCRIPTION OF THE DRAWINGS

Aspects of the present invention are illustrated by way of example and not limited in the accompanying figures, in which like reference numerals indicate similar elements throughout, and in which.

Figure 1:
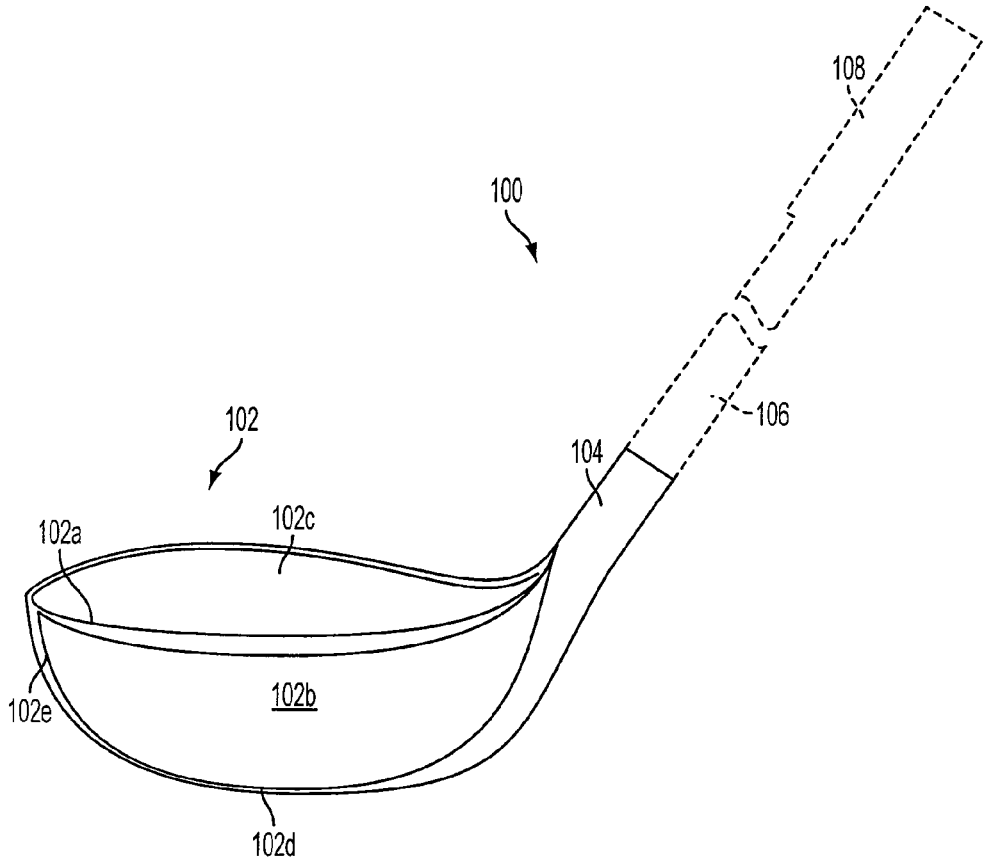
FIG. 1 generally illustrate features of a club head structure according to at least some examples of this invention.

The reader is advised that the various parts shown in these drawings are not necessarily drawn to scale.

DETAILED DESCRIPTION

The following description and the accompanying figures disclose features of golf club heads and golf clubs in accordance with examples of the present invention (e.g., wood or wood-type hybrid golf clubs and golf club heads).

I. General Description of Example Golf Club Heads, Golf Clubs, and Methods in Accordance with Aspects of this Invention Aspects of this invention relate to wood-type golf club heads and wood-type golf clubs including such club heads (e.g., drivers, fairway woods, wood-type hybrid clubs, or the like). Wood-type golf club heads according to at least some example aspects of this invention may include: (a) a ball striking face; and (b) a club head body coupled to (e.g. engaged or integrally formed with) the ball striking face, wherein the club head body includes a crown portion. The golf club head body includes a ball striking face portion, a rear portion opposite the ball striking face portion, a crown portion, a sole portion, a toe end portion, and a heel end portion. In certain aspects the golf club head further comprises a groove to accept a wrapping element and a wrapping element fitted to the head wherein at least a portion of the wrapping element engages the groove. At least a portion of the wrapping element may be positioned adjacent to and behind the ball striking face.

The wrapping element may be weighted in different areas to change the club from a draw-biased club, to a neutral club, to a fade-biased club. The wrapping element may be weighted by using different types of materials or by incorporating weights into the wrapping element itself either permanently (e.g. sewn into) or temporarily (e.g. insertion into a pocket). The weights may be in the form of magnets such that the magnets may also hold the wrapping element onto the golf club head body.

The head may further include one or more removable weight inserts, configured to be located in receptacles in the club head body under the wrapping element. The removable weight inserts may be located at any suitable position on the club head body away from the ball striking face.

The wood-type golf club head body may take on a variety of forms without departing from this invention. For example, the golf club head body may be made from any desired number of different parts, of any desired construction, from any desired materials, etc., without departing from this invention, including from conventional parts, of conventional constructions, and/or from conventional materials as are known and used in the art. In some example structures, the club head body will include one or more of the following parts: a crown portion, a sole portion, a face member (optionally including a ball striking face integrally formed therein or attached thereto), one or more body ribbons (e.g., forming or defining the periphery of the club head between the crown and sole portions), a sole plate, a frame member (optionally of metal, such as titanium alloys or the like, e.g., forming or defining the periphery of the club head between the crown and sole portions and/or to which one or more of the crown portion and/or the sole portion (if present) are engaged, etc.), an aft body, etc. The club head body may include: one or more metal alloy parts (e.g., a frame, optionally including or engaged with the ball striking face, a face member, etc.), such as stainless steel, titanium alloys, aluminum alloys, magnesium alloys, etc.; polymeric materials (e.g., for the crown or sole portions, for the club head body portions between the crown and sole portions, for the face member, etc.); composite materials, including fiber or particle reinforced composite materials, such as carbon fiber composite materials, basalt fiber composite materials, fiberglass materials, etc. (e.g., for the crown or sole portions, for the club head body portions between the crown and sole portions, for the face member, etc.). As yet another example, if desired, the club head body may have a unitary one piece construction, optionally with the frame member integrally formed therein, and further with a separate removable weight portion (and optionally a separate weight insert, if desired) engaged therewith. Any desired structure and/or arrangement of the club head body structure and/or its various parts may be used without departing from this invention.

Also, any desired construction for the wrapping element and corresponding grooves in the head may be used. For example the groove may be a continuous groove circumferentially around the head adjacent the ball striking face. A second groove may extend generally perpendicularly from the first groove at the crown portion around the rear portion to the first groove on the sole portion. The grooves may be of any shape, size, and depth to accommodate the wrapping element. For example, the wrapping element and corresponding groove may have a consistent width or an inconsistent width such as wider on the crown and sole portions and narrower along the heel and toe portions. The wrapping element may be of any suitable thickness, but should not affect the performance of the golf club. Moreover, the coefficient of friction of the wrapping element may be the same as or less than the coefficient of friction at the bottom of the club head body.

Alternatively, the groove may be formed only in the crown portion of the head or the club head body surface opposite the face plate. The wrap may be engaged with the groove by any suitable means such as with hook and loop or with magnets.

Also, any desired construction for the removable weight inserts may be used without departing from the invention. The weight inserts may be movably and/or releasably engaged from the club head body by removal of the wrapping element. The weight inserts may be any desired size and shape such as round, oval, and rectangular. The receptacle has a size and shape to accept the weight inserts.

Additional aspects of this invention relate to wood-type golf club structures that include golf club heads, e.g., of the types described above. Such wood-type golf club structures further may include one or more of: a shaft member attached to the club head (optionally via a separate hosel member or a hosel member provided as a part of one or more of the club head and/or shaft); a grip or handle member attached to the shaft member; an additional weight member attached to one or more of the club head body, shaft, or grip; etc.

The wrapping element may connect to the hosel via any suitable means such as a sleeve, a hook and loop fastener device, magnetic attraction, etc.

Still additional aspects of this invention relate to methods for making wood-type golf club heads and wood-type golf club structures in accordance with examples of this invention. Such methods may include, for example: (a) providing a golf club head of the various types described above (including any or all of the various structures, features, and/or arrangements described above), e.g., by manufacturing or otherwise making the golf club head, by obtaining it from a third party source, etc.; (b) engaging a shaft member with the golf club head; (c) engaging a grip member with the shaft member; (d) engaging a wrapping element with the club head body; and/or (e) engaging one or more weight portions with the club head.

Additional aspects of this invention relate to methods of using wood-type golf club heads, e.g., of the various types described above. Such methods may include, for example, removing or exchanging the wrapping element, changing the weighting characteristics of the wrapping element, or changing the color of the wrapping element for identification purposes. The methods may remove or exchange the wrapping element for moving or exchanging the removable weight inserts to various positions along the crown portion, sole portion or rear portion of the club head. In this manner, golf clubs and golf club heads in accordance with examples of this invention may be customized, e.g., to better fit or conform to a specific golfer's swing characteristics, to help correct or compensate for various swing flaws (e.g., to correct hooks, slices, etc.), to bias a club for specific types of ball flights (e.g., a draw bias, a fade bias, a low flight bias, a high flight bias, etc.), and the like. Golf club heads and/or golf clubs according to the invention also may be used by club fitters to find desired or optimal weighting characteristics for specific golfers, and if desired, such characteristics may be used in selecting parts, arranging weights, and/or weighting for a final, permanently weighted club structure.

Given the general description of various example aspects of the invention provided above, more detailed descriptions of various specific examples of golf clubs and golf club head structures according to the invention are provided below.

II. Detailed Description of Example Golf Club Heads, Golf Club Structures, and Methods According to Aspects of the Invention The following discussion and accompanying figures describe various example golf clubs and golf club head structures in accordance with aspects of the present invention. When the same reference number appears in more than one drawing, that reference number is used consistently in this specification and the drawings to refer to the same or similar parts throughout.

Example golf club and golf club head structures in accordance with this invention may constitute "wood-type" golf clubs and golf club heads, e.g., clubs and club heads typically used for drivers and fairway woods, as well as for "wood-type" utility or hybrid clubs, or the like. Such club head structures may have little or no actual "wood" material and still may be referred to conventionally in the art as "woods" (e.g., "metal woods," "fairway woods," etc.). The club heads may include a multiple piece construction and structure, e.g., including one or more of a sole member, a face member (optionally including a ball striking face integrally formed therein or attached thereto), one or more body members (e.g., ribbons of material extending around the perimeter and making up the club head body), a crown member, a face plate, a face frame member (to which a ball striking face may be attached), an aft body, etc. Of course, if desired, various portions of the club head structure may be integrally formed with one another, as a unitary, one piece construction, without departing from the invention (e.g., the body member(s) may be integrally formed with the sole and/or crown members, the face member may be integrally formed with the sole, body, and/or crown members, etc.). Optionally, if desired, the various portions of the club head structure (such as the sole member, the crown member, the face member, the body member(s), etc.) individually may be formed from multiple pieces of material without departing from this invention (e.g., a multi-piece crown, a multi-piece sole, etc.). Also, as other alternatives, if desired, the entire club head may be made as a single, one piece, unitary construction, or a face plate member may be attached to a one piece club head aft body (optionally, a hollow body, etc.). More specific examples and features of wood-type golf club heads and golf club structures according to this invention will be described in detail below in conjunction with the example golf club structures illustrated in FIGS. 1 through 6.

FIG. 1 generally illustrates an example wood-type golf club 100 and/or golf club head 102 in accordance with this invention. In addition to the golf club head 102, the overall golf club structure 100 of this example includes a hosel region 104, a shaft member 106 received in and/or inserted into and/or through the hosel region 104, and a grip or handle member 108 attached to the shaft member 106. Optionally, if desired, the external hosel region 104 may be eliminated and the shaft member 106 may be directly inserted into and/or otherwise attached to the head member 102 (e.g., through an opening provided in the top of the club head 102, through an internal hosel member (e.g., provided within an interior chamber defined by the club head 102), etc.).

The shaft member 106 may be received in, engaged with, and/or attached to the club head 102 in any suitable or desired manner, including in conventional manners known and used in the art, without departing from the invention. As more specific examples, the shaft member 106 may be engaged with the club head 102 via a hosel member 104 and/or directly to the club head structure 102, e.g., via adhesives, cements, welding, soldering, mechanical connectors (such as threads, retaining elements, or the like), etc.; through a shaft-receiving sleeve or element extending into the club head body 102; etc. The shaft member 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member 108 may be attached to, engaged with, and/or extend from the shaft member 106 in any suitable or desired manner, including in conventional manners known and used in the art, e.g., using adhesives or cements; via welding, soldering, adhesives, or the like; via mechanical connectors (such as threads, retaining elements, etc.); etc. As another example, if desired, the grip or handle member 108 may be integrally formed as a unitary, one-piece construction with the shaft member 106. Additionally, any desired grip or handle member 108 materials may be used without departing from this invention, including, for example: rubber materials, leather materials, rubber or other materials including cord or other fabric material embedded therein, polymeric materials, and the like.

The club head 102 also may be constructed in any suitable or desired manner and/or from any suitable or desired materials without departing from this invention, including from conventional materials and/or in conventional manners known and used in the art. In the example structure 102 shown in FIG. 1, the club head 102 includes a ball striking face member 102*a* (including a ball striking face plate 102*b* integrally formed with the face member 102*a* or attached to a frame member such that the face plate 102*b* and frame member together constitute the overall face member 102*a*). The club head 102 of this illustrated example further includes a crown portion 102*c*, a sole portion 102*d*, and at least one body portion 102*e* located between the crown portion 102*c* and the sole portion 102*d* (e.g. extending from the face member 102*a* toe to heel and around the club head periphery).

A wide variety of overall club head constructions are possible without departing from this invention. For example, if desired, some or all of the various individual parts of the club head 102 described above may be made from multiple pieces that are connected together (e.g., by welding, adhesives, or other fusing techniques; by mechanical connectors; etc.). The various parts (e.g., crown portion 102*c*, sole portion 102*d*, and/or body portion(s) 102*e*) may be made from any desired materials and combinations of different materials, including materials that are conventionally known and used in the art, such as metal materials, including lightweight metal materials. More specific examples of suitable lightweight metal materials include steel, titanium alloys, aluminum alloys, magnesium alloys, etc.

As additional examples or alternatives, in order to reduce weight of the club head 102, if desired, one or more portions of the club head structure 102 advantageously may be made from a composite material, such as from carbon fiber composite materials that are conventionally known and used in the art. Other suitable composite or other non-metal materials that may be used for one or more portions of the club head structure 102 include, for example: fiberglass composite materials, basalt fiber composite materials, polymer materials, etc. As some more specific examples, if desired, at least some portion(s) of the crown member 102*c* may be made from composite or other non-metal materials. Additionally or alternatively, if desired, at least some portion(s) of the sole member 102*d* may be made from composite or other non-metal materials. As still additional examples or alternatives, if desired, one or more portions of the club head's body member 102*e* (the regions extending between the crown portion 102*c* and the sole portion 102*d*) may be made from composite or other non-metal materials. As yet further examples, if desired, the entire body portion of the club head aft of a club head face member 102*a* (also called an "aft body"), or optionally the entire club head, may be made from composite or other non-metal materials without departing from this invention. The composite or other non-metal material(s) may be incorporated as part of the club head structure 102 in any desired manner, including in conventional manners that are known and used in the art. Reducing the club head's weight (e.g., through the use of composite or other non-metal materials, lightweight metals, metallic foam or other cellular structured materials, etc.) allows club designers and/or club fitters to selectively position additional weight in the overall club head structure 102, e.g., to desirable locations to increase the moment of inertia (MOI) and/or affect other playability characteristics of the club head structure 102 (e.g., to draw or fade bias a club head; to help get shots airborne by providing a low center of gravity; to help produce a lower, more boring ball flight; to help correct or compensate for swing flaws that produce undesired ball flights, such as hooks or slices, ballooning shots, etc.; etc.).

The various individual parts that make up a club head structure 102, if made from multiple pieces, may be engaged with one another and/or held together in any suitable or desired manner, including in conventional manners known and used in the art. For example, the various parts of the club head structure 102, such as the face member 102*a*, the ball striking plate 102*b*, the crown portion 102*c*, the sole portion, 102*d*, and/or the body portion(s) 102*e* may be joined and/or fixed together (directly or indirectly through intermediate members) by adhesives, cements, welding, soldering, or other bonding or finishing techniques; by mechanical connectors (such as threads, screws, nuts, bolts, or other connectors); and the like. If desired, the mating edges of various parts of the club head structure 102 (e.g., the edges where members 102*a*, 102*b*, 102*c*, 102*d*, and/or 102*e* contact and join to one another) may include one or more raised ribs, tabs, ledges, or other engagement elements that fit into or onto corresponding grooves, slots, surfaces, ledges, openings, or other structures provided in or on the facing side edge to which it is joined. Cements, adhesives, mechanical connectors, finishing material, or the like may be used in combination with the raised rib/groove/ledge/edge or other connecting structures described above to further help secure the various parts of the club head structure 102 together.

The dimensions and/or other characteristics of a golf club head structure 102 according to examples of this invention may vary significantly without departing from the invention. As some more specific examples, club heads in accordance with at least some examples of this invention may have dimensions and/or other characteristics that fall within the various example ranges of dimensions and/or characteristics of the club heads described in U.S. patent application Ser. No. 11/125,327 filed May 10, 2005 (and corresponding to U.S. Published Patent Appln. No. 2005-0239576 A1 published Oct. 27, 2005). Note, for example, the Tables in these documents. This U.S. patent publication is entirely incorporated herein by reference. In accordance with at least some example club head structures described in this invention, the ratio of the breadth dimension (i.e., overall dimension "B" in the front to back direction) to length dimension (i.e., overall dimension "L" from in the heel to toe direction) (i.e., ratio "B/L") will be at least 0.9, and in some examples, this ratio may be at least 0.92, at least 0.93, at least 0.94, at least 0.95, at least 0.96, at least 0.97, or even at least 0.98. The club head may have any desired volume, including, for example, a volume of at least 200 cc (cubic centimeters), and in some examples at least 350 cc, at least 400 cc, at least 420 cc, or even at least 450 cc. It will be appreciated that the breadth dimension to length dimension and volume could be outside these listed ranges.

FIGS. 2A-2D—Wrapping Element and Groove in Club Head Body

Figure 2A:
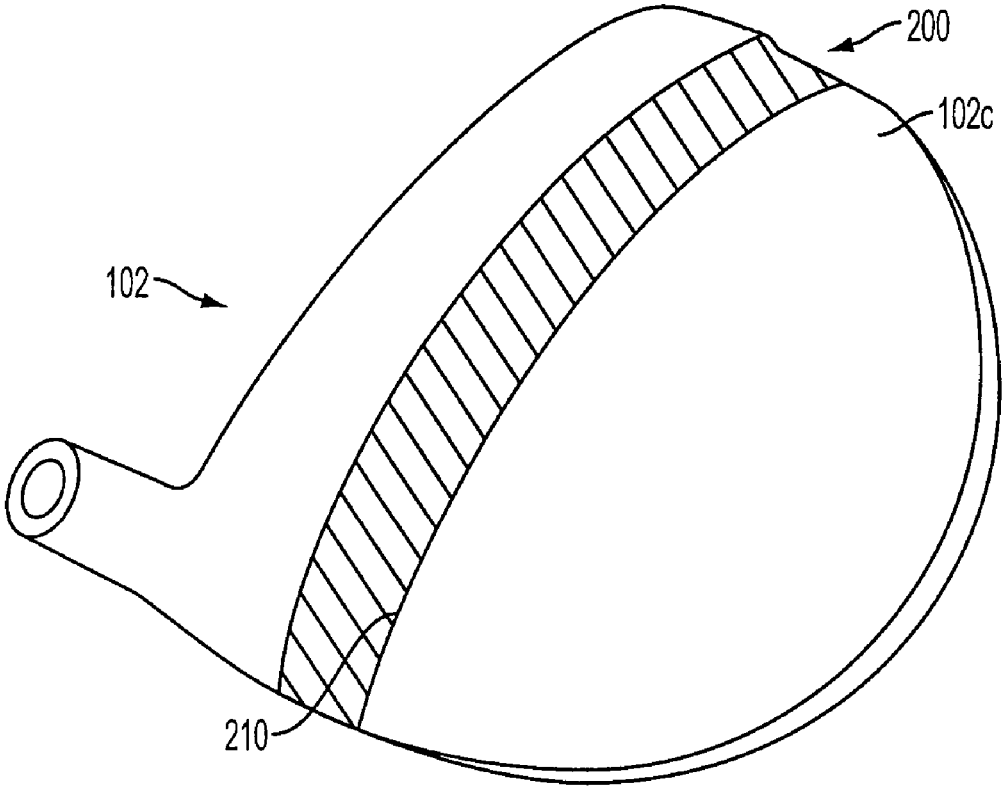
FIGS. 2A through 2D illustrate a golf club head structure including a removable wrapping element in accordance with at least some examples of this invention.
Figure 2B:
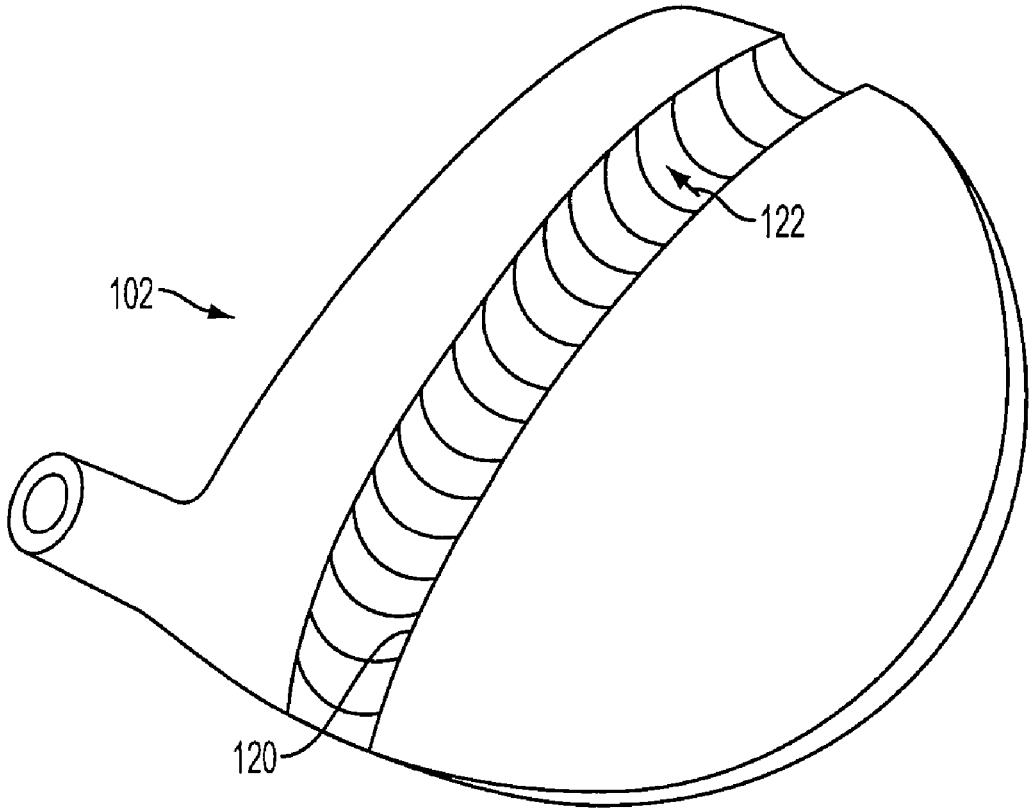
Figure 2C:
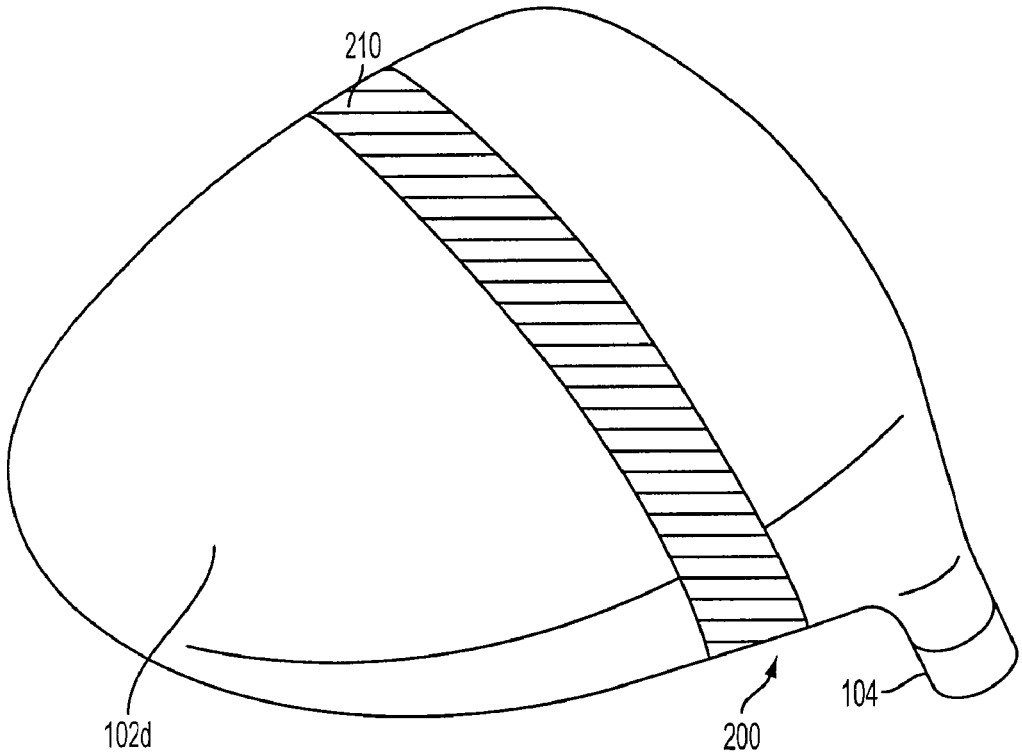
Figure 2D:
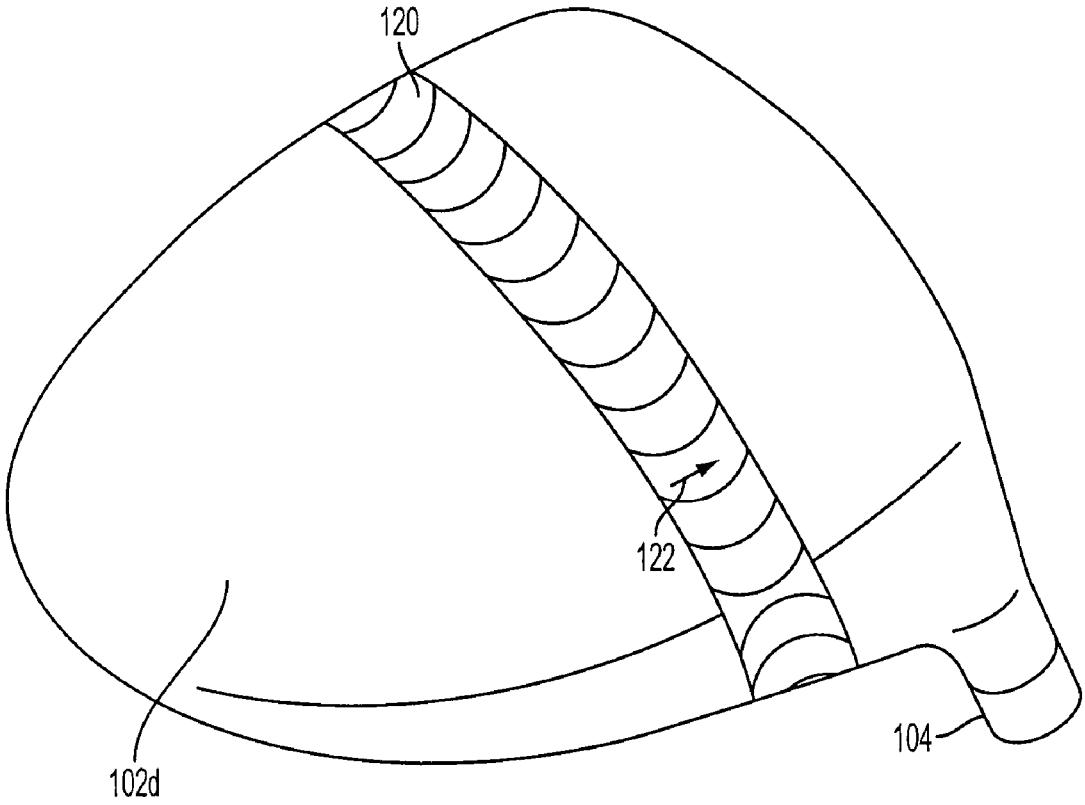

FIG. 2A specifically illustrates the feature of wrapping element portion 200. In one illustrative aspect, the crown portion 102*c* and sole portion 102*d* generally include a groove 120 extending circumferentially around the head as shown in FIG. 2B and FIG. 2D. Wrapping element portion 200 engages the groove 120. Wrapping element 200 has, for example, a continuous strap 210. The wrapping element may be located adjacent to and proximal to the ball striking face 102*b* as shown in FIG. 2A and FIG. 2C.

The wrapping element may be made of any suitable material such as a fabric, a polymeric material, an elastic material, a stretchable material, a cord, a yarn, a cable, a band, a filament, or combinations thereof. The wrapping element may have some elasticity in order to stretch to fit over the head but fit snugly in the groove after placement thereof. Alternatively, the wrapping element may contain two ends that are connected to each other when placed in the groove, such as by a hook and loop fastener or other suitable connecting means. The wrapping element may be of different colors and textures although generally a smooth texture is desired.

The groove is of sufficient width and thickness to accommodate the wrapping element. The wrapping element may have any suitable or desired width and thickness. The wrapping element may also have several widths, for example, the wrapping element may be wider in the crown or sole portions and narrower in the heel and toe portions. The width of the groove corresponds to the width of the wrapping element. Likewise, the wrapping element may have different thicknesses whereby the groove accommodates such thicknesses.

The wrapping element may be weighted. Such weighting may be consistent throughout the wrapping element or the wrapping element may have portions that are weighted differently. The weighted wrapping elements may be easily exchanged depending on the desire of the user. For example, a wrapping element weighted in a crown portion may be easily exchanged for a wrapping element weighted in the toe end portion or sole portion by simply removing the wrapping element and replacing it with another wrapping element. The wrapping element may further be weighted with magnets whereby the magnets help hold the wrapping element onto the golf club head body.

Portions of the groove in the club head may provide an indication (e.g., a marking) to specify how to position the wrapping element within the groove to provide a particular weighting configuration. The wrapping element may also have an indicator as to where the weighting portion(s) is located within the element. See, for example, arrows 122 in FIGS. 2B and 2D.

Figure 5:
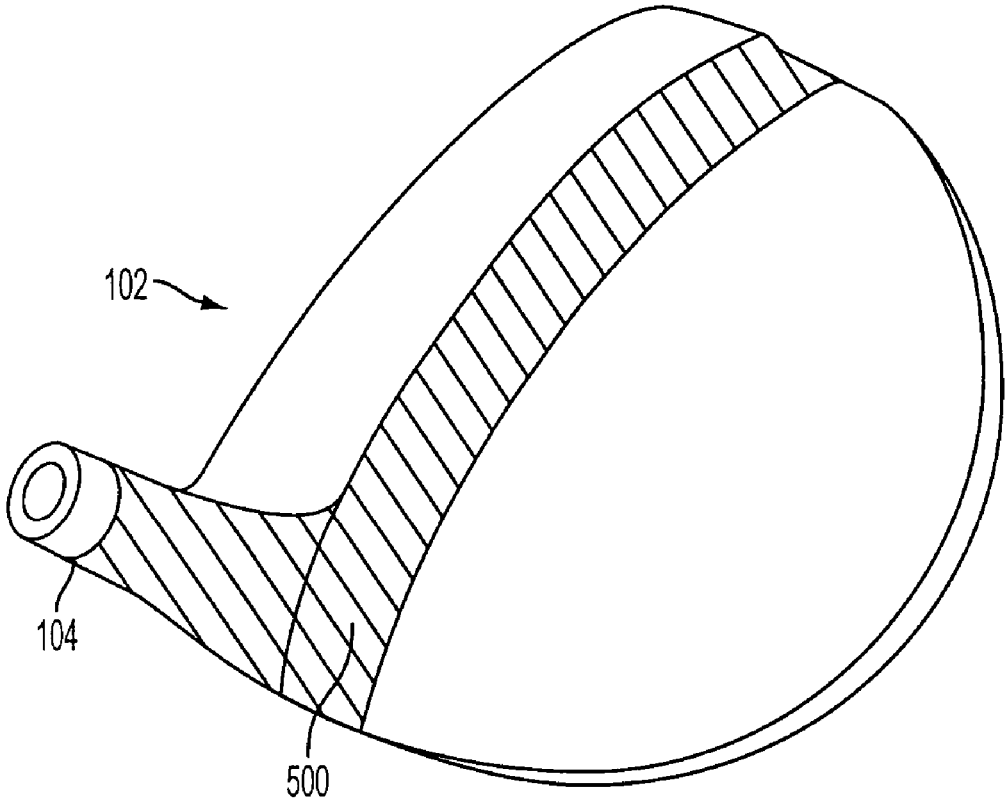
FIG. 5 illustrates another golf club head structure including a removable wrapping element attached to a hosel in accordance with at least some examples of this invention.

The wrapping element may connect to the hosel via any suitable means such as a sleeve, a hook, or hook and loop fastener. FIG. 5 shows a general depiction of a wrapping element 500 connected to the hosel 104 of the club head body 102.

It will be appreciated that in the illustrative embodiment depicted in FIG. 2A, the general profile of the club head 102 is maintained when the wrapping element 200 is attached to the club head 102. In other implementations of the invention, the profile of the club head 102 may change.

FIGS. 3A-3D—Wrapping Element and Groove in Club Head Body

Figure 3A:
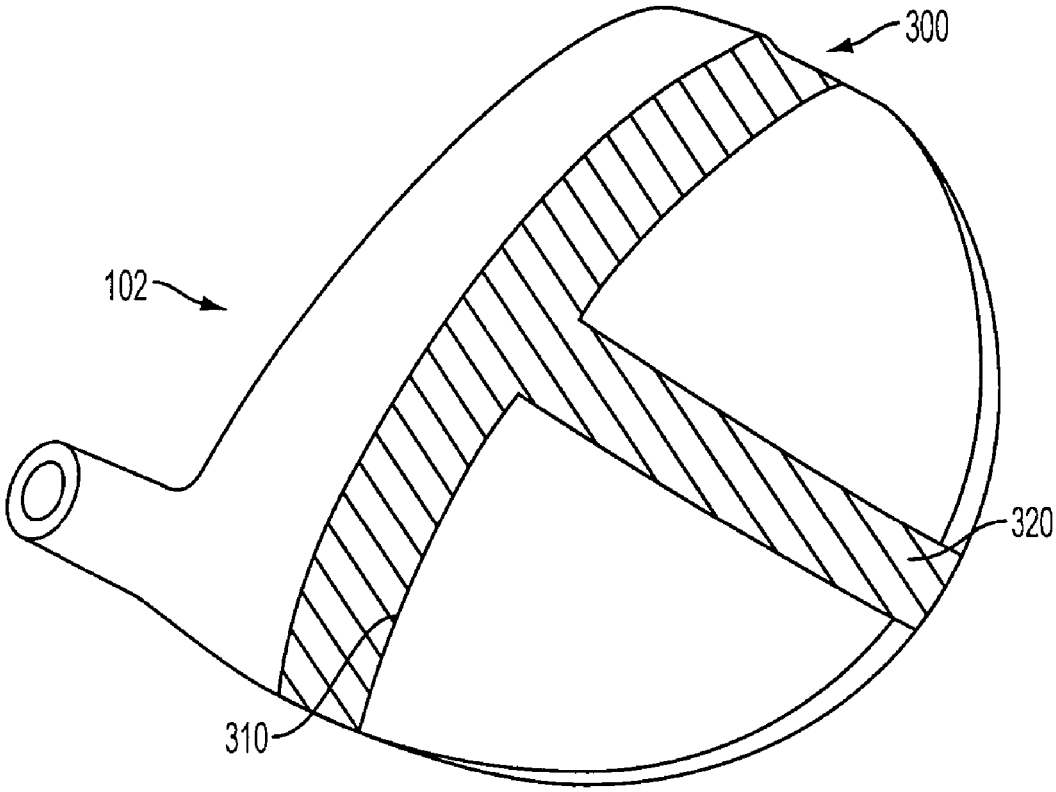
FIGS. 3A through 3D illustrate another golf club head structure including a removable wrapping element in accordance with at least some examples of this invention.
Figure 3B:
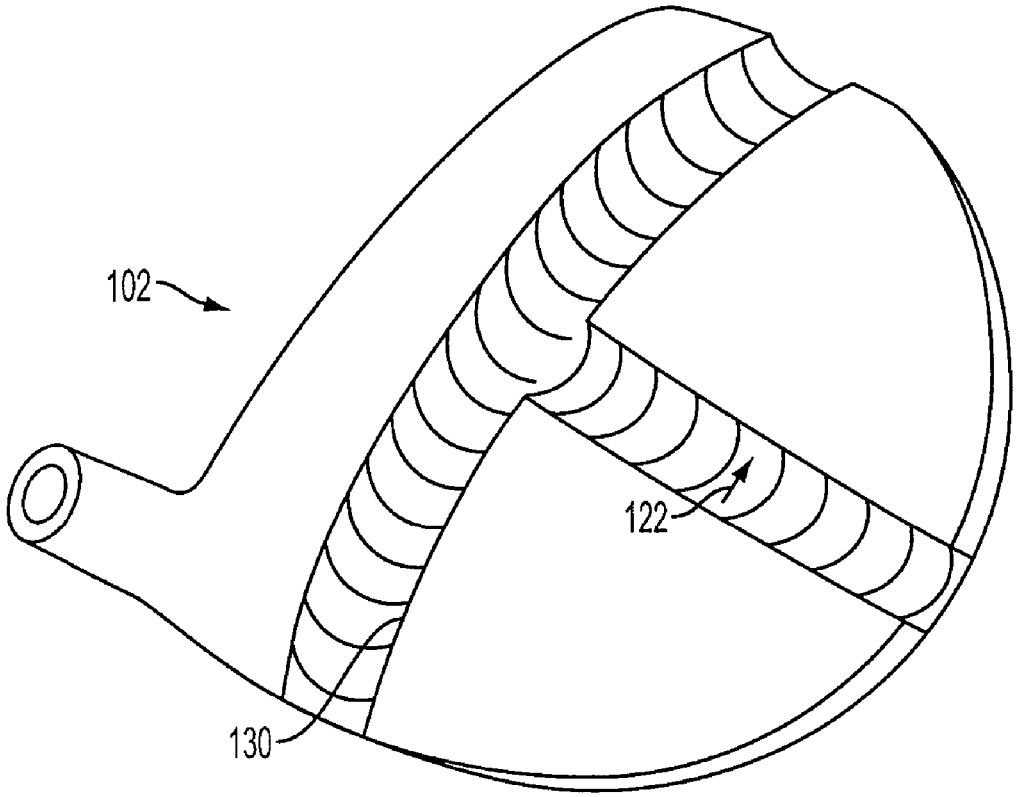
Figure 3C:
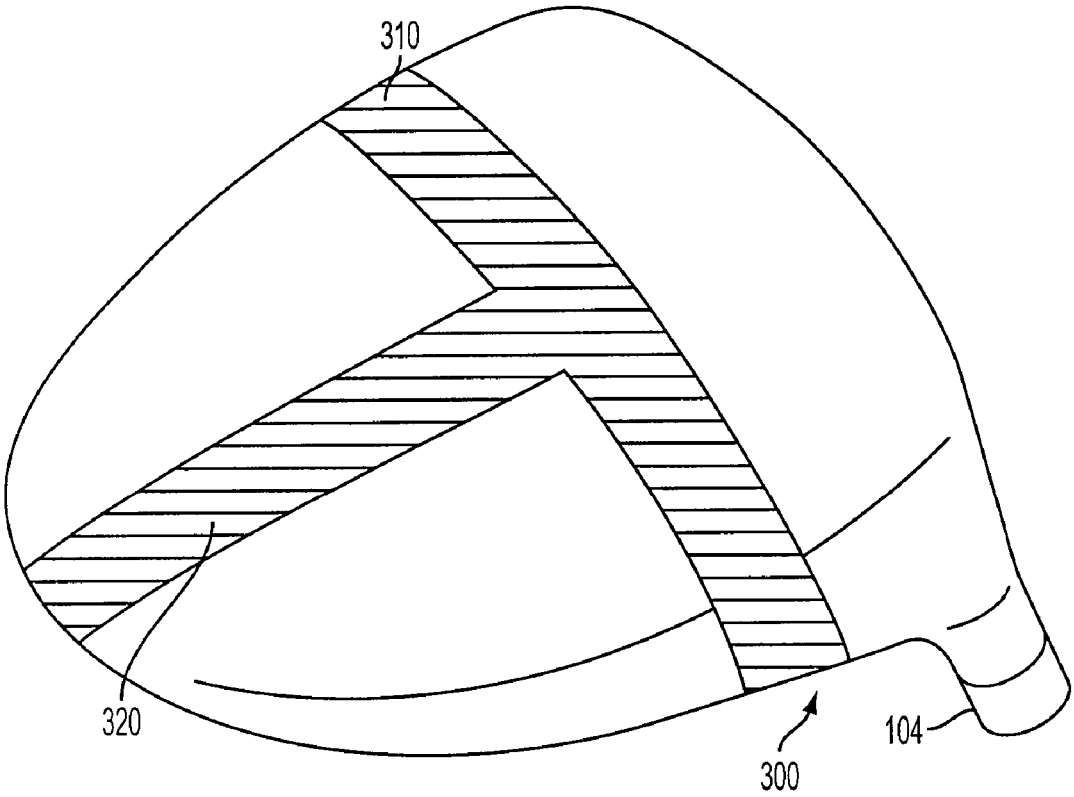
Figure 3D:
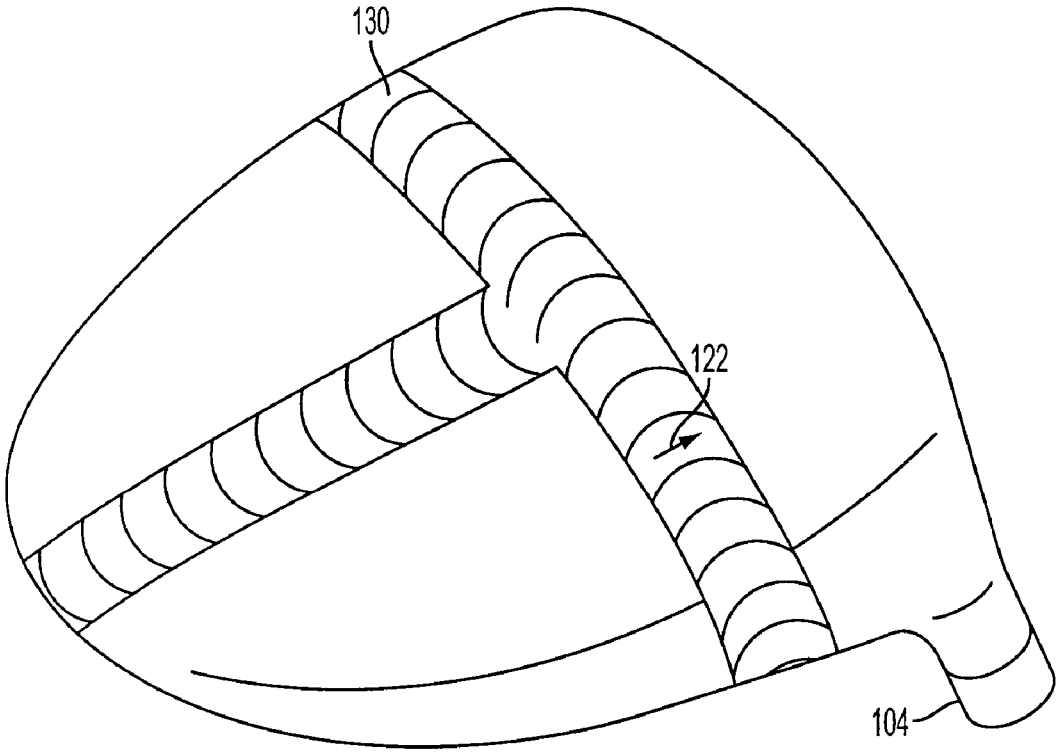

FIGS. 3A-3D describe another illustrative embodiment. FIG. 3A specifically illustrates the feature of wrapping element portion 300. The crown portion 102*c* and sole portion 102*d* generally include a groove 130 extending circumferentially around the head as shown in FIG. 3B and FIG. 3C and further extending from the crown portion to the sole portion around the rear portion of the head. Wrapping element portion 300 engages the groove 130. Wrapping element 300, for example, has a strap including a first strap portion 310 located adjacent to and proximal to the ball striking face 102*b* and a second strap portion 320 connected to the first strap portion 310 at the crown portion 102*c* extending around the rear portion and at the sole portion as shown in FIG. 3A and FIG. 3C.

The wrapping element may be made of any suitable material such as a fabric, a polymeric material, an elastic material, a stretchable material, or combinations thereof. The wrapping element may have some elasticity in order to stretch to fit over the head but fit snugly in the groove after placement thereof. Alternatively, the wrapping element may contain two or more ends that are connected to each other when placed in the groove, such as by a hook and loop fastener or other suitable connecting means. The wrapping element may be of different colors and textures although generally a smooth texture is desired.

The groove is of sufficient width to accommodate the wrapping element. The wrapping element may have any suitable or desired width. The wrapping element may also have several widths, for example, the wrapping element may be wider in the crown or sole portions and narrower in the heel and toe portions. The width of the groove corresponds to the width of the wrapping element. Likewise, the wrapping element may have different thicknesses whereby the groove accommodates such thicknesses.

The wrapping element may be weighted. Such weighting may be consistent throughout the wrapping element or the wrapping element may have portions that are weighted differently. The weighted wrapping elements may be easily exchanged depending on the desired effect for purposes of controlling the ball flight. For example, a wrapping element weighted in a crown portion may be easily exchanged for a wrapping element weighted in the toe end portion or sole portion by simply removing the wrapping element and replacing it with another wrapping element. The wrapping element may further be weighted with magnets whereby the magnets help hold the wrapping element onto the golf club head body.

Portions of the groove in the club head may provide an indication (e.g., a marking) to specify how to position the wrapping element within the groove to provide a particular weighting configuration. See, for example, arrows 122 in FIGS. 3B and 3D. The wrapping element may also have an indicator as to where the weighting portion(s) is located in the element.

The wrapping element may connect to the hosel via any suitable means such as a sleeve, a hook, or hook and loop fastener. FIG. 5 shows a general depiction of a wrapping element connected to the hosel.

It will be appreciated that in the illustrative embodiment depicted in FIG. 3A, the general profile of the club head 102 is maintained when the wrapping element 300 is attached to the club head 102. In other implementations of the invention, the profile of the club head 102 may change.

Figure 6A:
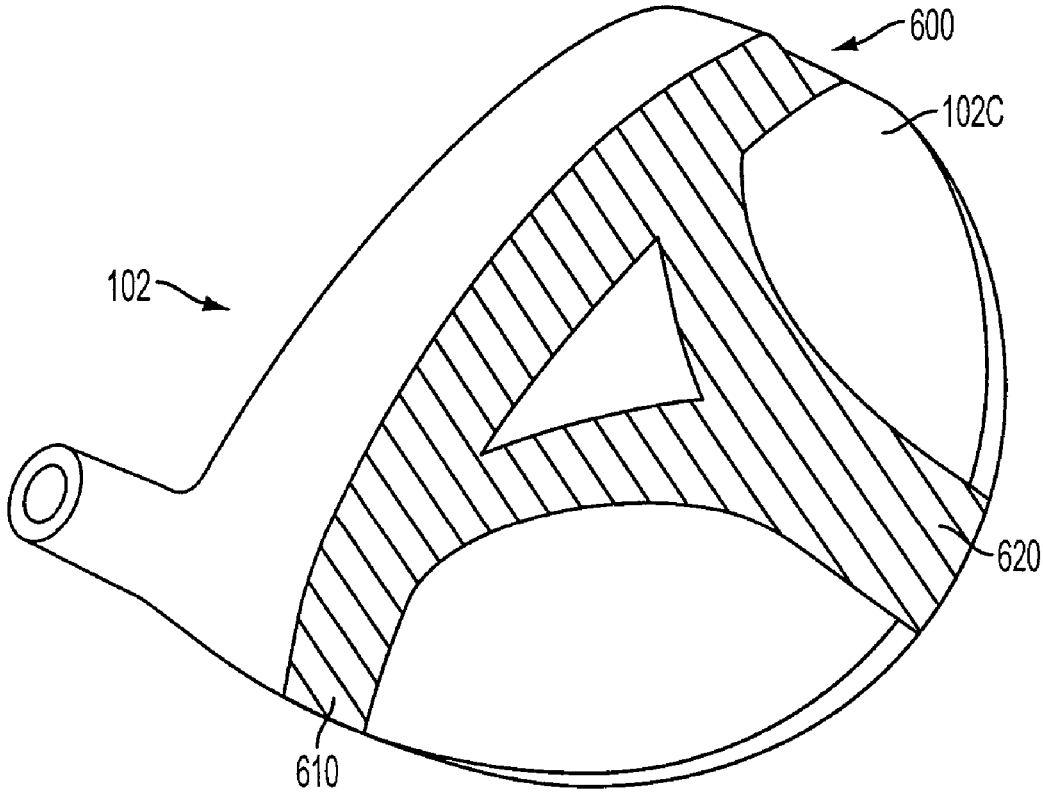
FIGS. 6A and 6B illustrate another golf club head structure including a removable wrapping element in accordance with at least some examples of this invention.
Figure 6B:
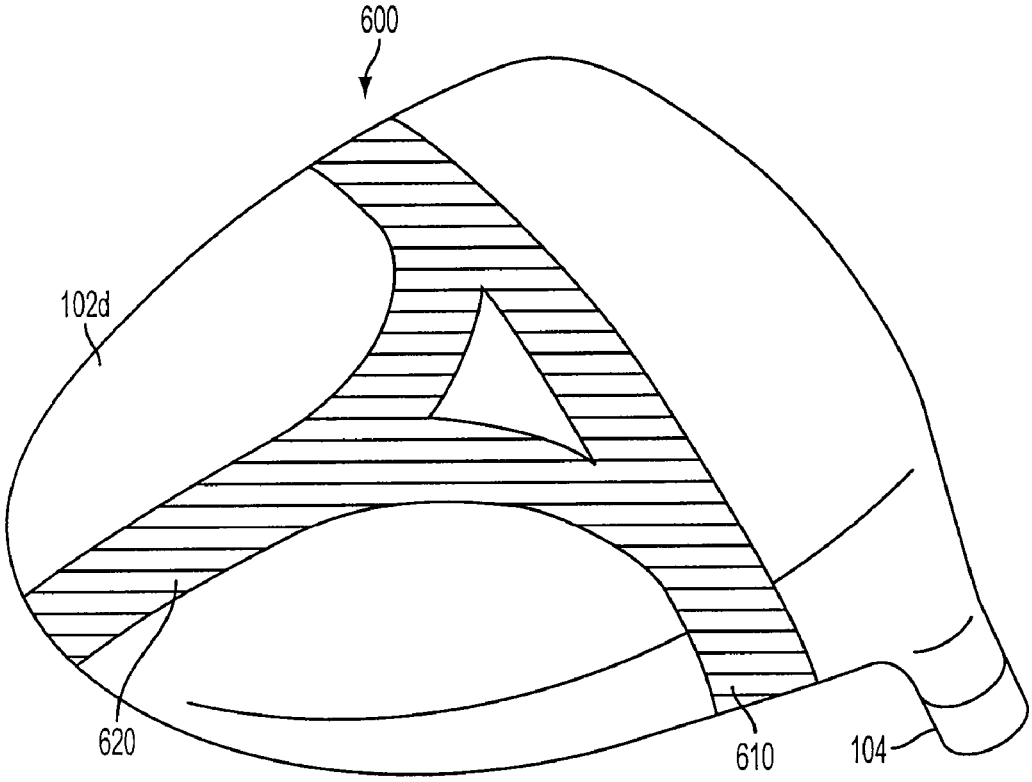

FIGS. 6A-6B—Wrapping Element and Groove in Club Head Body

FIGS. 6A to 6B show a wrapping element similar to FIGS. 3A and 3C. Wrapping element 600, for example, has a strap including a first strap portion 610 located adjacent to and proximal to the ball striking face 102*b* and a second strap portion 620 connected to the first strap portion 610 at the crown portion 102*c* in a "Y" configuration and extending around the rear portion and at the sole portion as shown in FIG. 6A and FIG. 6B. The configuration of the second strap portion is not limited. For example, the second strap portion may have a "Y" configuration on the crown and an attachment such as shown in FIG. 3C at the sole. Moreover, there is no limit to the number of strap portions that may be coupled to each other.

FIGS. 4A-4D—Removable Weights and Receptacles

Figure 4A:
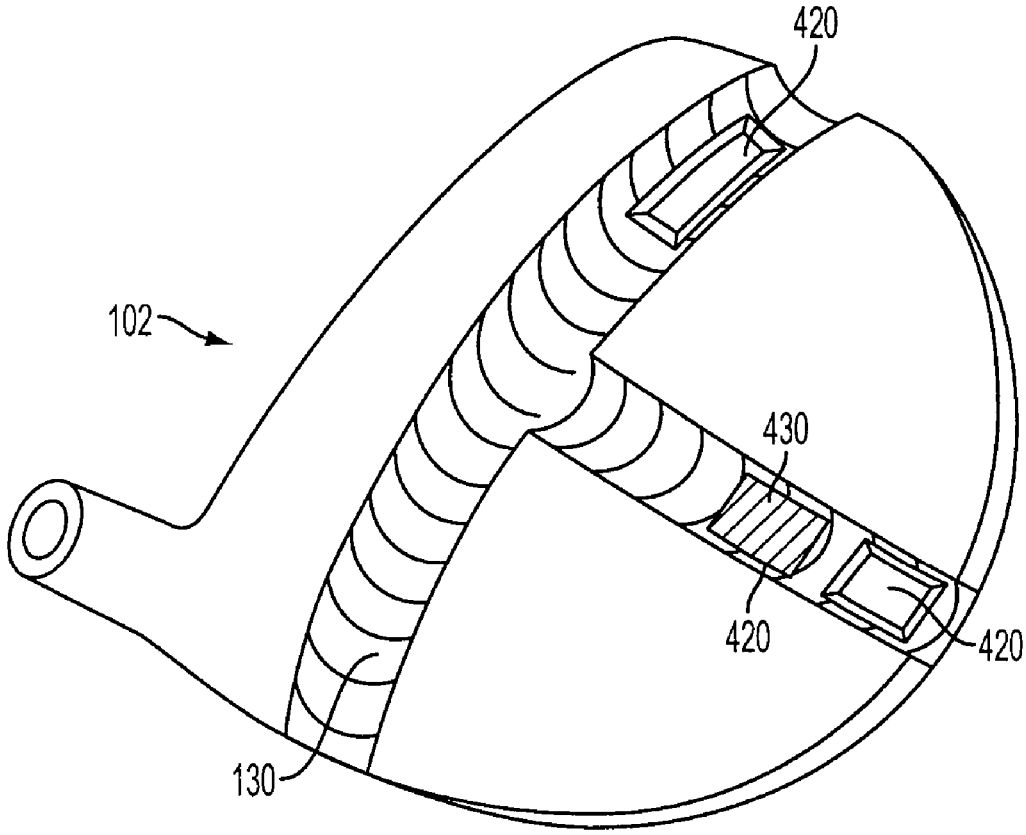
FIGS. 4A and 4B illustrate a golf club head structure including weight inserts that may be used in accordance with at least some examples of this invention.
Figure 4B:
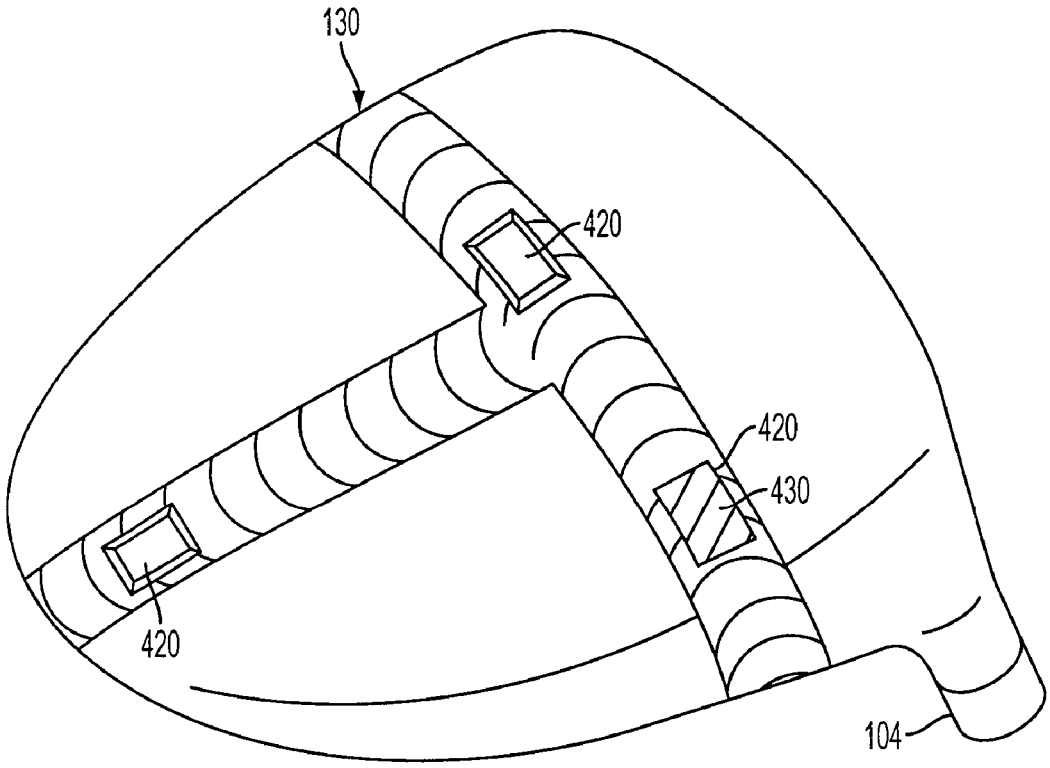

The head may further comprise one or more receptacles or cavities for removable weight inserts. Such receptacles can be positioned within the grooves so that the wrapping element covers the receptacles. When weight inserts are placed into the receptacle, the wrapping element then covers the removable weight inserts and holds the weight inserts into place. Receptacles 420 are positioned in groove 130 as shown in FIGS. 4A and 4B. The receptacles may be of any suitable number, size, shape, and depth to accommodate the removable weight inserts. The removable weight inserts 430 can be placed in receptacles 420 as shown in FIG. 4A and FIG. 4B. A gasket may be used between the removable weight inserts and the club head.

The removable weight inserts 430 may be located at the front or rear area of the crown portion 102*c* or the front or rear area of the sole portion 102*d*.

A wide variety of sizes, shapes, positioning, orientations, relative orientations, mass, and/or materials may be used for the removable weight insert 430, without departing from this invention. Such constructions enable users (or club fitters) to provide additional weight in the toe and/or rear portion(s) of an overall club head structure 102, which can be useful to provide a fade biased club and/or a club that helps compensate for swing flaws that typically produce a drawing or hooking ball flight.

Also, changing the removable weight inserts 430, may allow users or club fitters to affect the flight of balls propelled using club heads 102 and golf clubs 100 in accordance with these examples of the invention. For example, it is typically easier for at least some golfers to get a golf ball airborne using a club head 102 having significant weight located lower and toward the rear of the club head 102. Such weight positioning also may be used to provide a higher, more lofted golf ball flight path, at least for some golfers. Under some play conditions and/or for some swing types, however, this higher flight bias and/or ball flight path may not be desirable. For example, to produce lower, more boring ball flights, e.g., for play in windy conditions, or for swing flaws that typically produce an excessively high, ballooning ball flight, the weight may be positioned more forward toward the ball striking face 102*b*.

FIG. 7—Attachment of Strap Segments

Figure 7A:
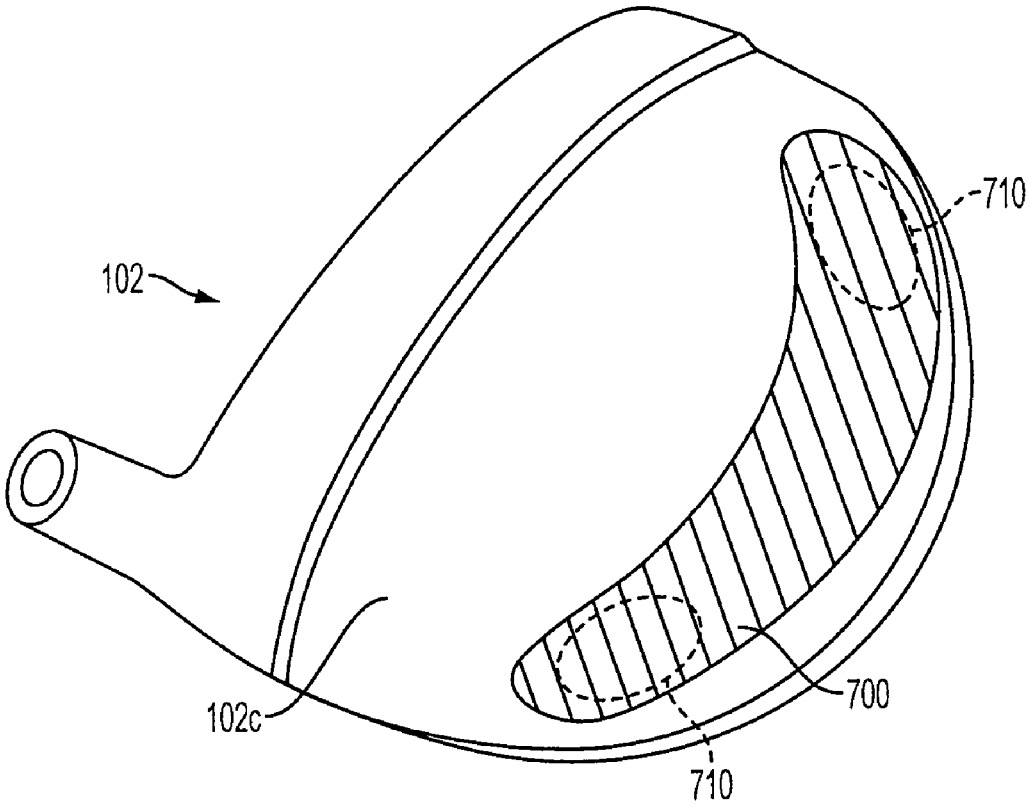
FIGS. 7A and 7B illustrate another golf club head structure including a removable wrapping element in accordance with at least some examples of this invention.
Figure 7B:
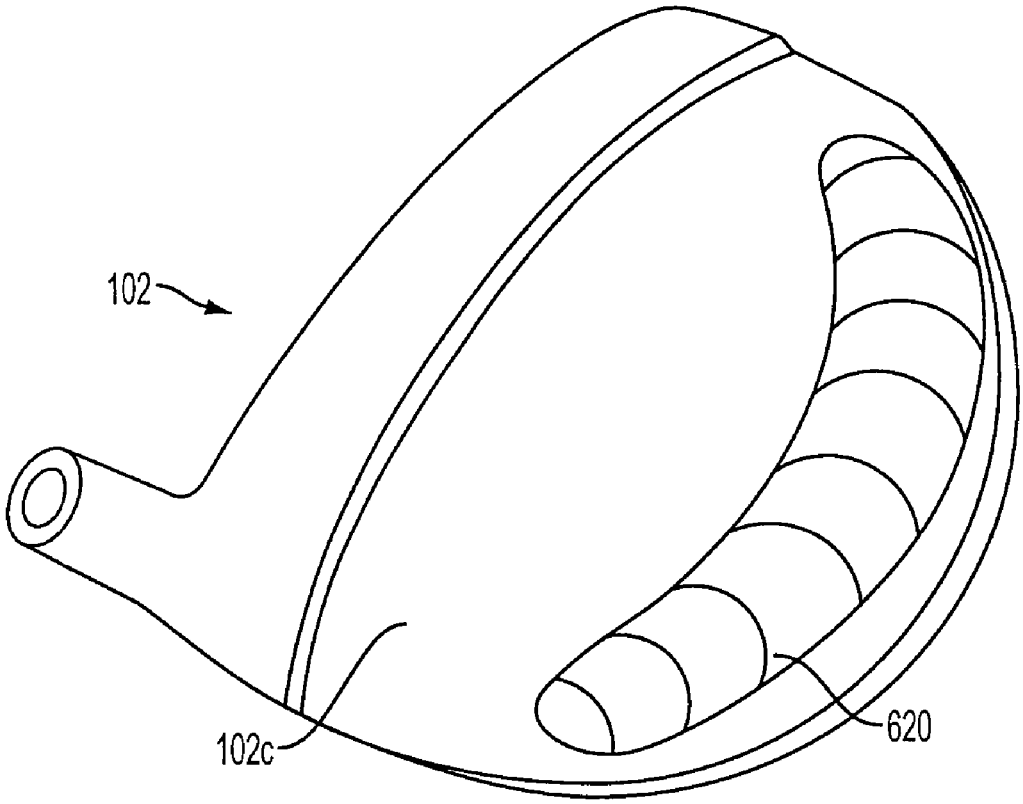

In another aspect of the invention, the wrapping element may comprise a strap portion that does not extend around the club head body. The strap portion contains an attachment means to hold the strap into place on the club head body. Such attachment means may be magnets or hook and loop fasteners for example. FIG. 7A shows a wrapping element having strap portion 700 attached to the club head body with magnets 710. FIG. 7B shows the groove 720 in which the strap portion can be located. The strap portion 700 and corresponding groove 720 may be positioned in any suitable place on the golf club head body. In addition, the strap portion may contain weighting elements or may cover receptacles in the club head body that hold weight inserts as discussed above.

General Construction

The crown portion 102*c* and sole portion 102*d* may be held together in other ways as well, without departing from this invention. For example, mechanical connectors other than screws or bolts may be used, such as retaining members, spring loaded detents or other mechanisms, etc. As still additional examples, if desired, magnets, adhesives or cements, as well as soldering, brazing, welding, and/or other fusing techniques may be used, at least in part, to hold one or more of the various parts of the club head structure 102 together and/or to one another. Also, any combination of techniques, such as the techniques described above, may be used to hold one or more of the various parts of the club head structure 102 together.

The crown member 102*c* and/or the sole member 102*d* may be made from any desired material, including the same or different materials without departing from this invention. In at least some example structures, the crown member 102*c* and/or the sole member 102*c* will be made of a lightweight material, such as: a polymeric material; a composite material (such as carbon fiber composites, fiberglass materials, basalt fiber composites, and the like); a lightweight metal material (e.g., titanium alloys, aluminum alloys, magnesium alloys, etc.). Additionally, the crown member 102*c* and/or the sole member 102*d* may be made from conventional materials that are known and used in the golf club art. These parts also may be made from and formed into desired shapes using fabrication techniques that also are well known and used in the art (e.g., by molding techniques, such as blow molding or injection molding of polymeric materials, molding or shaping of composite materials, etc.; by conventional metal fabrication and shaping techniques, such as molding, shaping, casting, forging, machining, etc.; and the like).

If desired, the crown member 102*c* and/or the sole member 102*d* may serve as mounting elements or bases for still further elements, such as finishing materials (e.g., paint, enamel, or other finishing materials) to provide a desired aesthetic appearance; a sole plate (e.g., made of metal or other durable materials) to protect at least portions of the club head structure 102 during use (e.g., when the club head contacts the ground during a swing, etc.); etc. Use of such additional elements may be accomplished in conventional ways that are known and used in the art. As a more specific example, a sole plate (optionally made from a metal material) may be fixed to the sole portion 102*d*, e.g., using mechanical connectors, cements, adhesives, etc.

While various wrapping elements and weight inserts structures and techniques are described above in conjunction with various specific structures shown in FIGS. 1 through 7, features and aspects of this invention may be applied to a wide variety of club head structures or constructions without departing from the invention. For example, a wide variety of constructions, numbers of parts, combinations of materials, and the like may be used, including constructions, parts, and combinations of materials that are known and used in the art. More specific examples of additional potential club head constructions that may include wrapping elements and weight inserts of the types described above include, but are not limited to: one piece club constructions, e.g., of metallic or metal alloy materials, polymer-containing materials, or composite-containing materials, either as a solid material or having a hollow interior chamber within the club head; constructions having a face member (e.g., a face frame member with a face plate attached thereto or integrally formed therewith) with an aft body attached thereto (the aft body may be constructed from one or more of metallic or metal alloy materials, polymer-containing materials, or composite-containing materials, either as a solid material or having a hollowed out interior chamber); multi-piece constructions, e.g., constructions having a face member (e.g., a face frame member with a face plate attached thereto or integrally formed therewith) with a multi-piece body attached thereto (the body may be constructed from one or more of metallic or metal alloy materials, polymer-containing materials, or composite-containing materials, e.g., including one or more of a crown member, a sole member, one or more body ribbons, etc); etc. A wide variety of other constructions also are possible.

Weight adjustable golf club heads of the types described above may be used by golfers, on the golf course, for their regular play (golfers can maintain the ability to modify the weight settings and/or customize the club head to their swing characteristics). As another example, however, golf club heads in accordance with at least some examples of this invention (e.g., of the types described above) also may be useful for club fitting purposes. For example, removable weights of the types described above, club fitters and/or users can quickly adjust the playing characteristics of a club head by adjusting the position(s) of the removable weight inserts provided with the club head. In this manner, a golfer being fit for new clubs and/or club components can quickly try different weighting characteristics for the club head using a single club head (as opposed to the club fitter having to carry a large inventory of club heads each with slightly different weighting characteristics). Then, when a weight arrangement and/or orientation is found that best suits a golfer's swing characteristics and/or provides a desired ball flight path, based on the adjustable club head's settings (e.g., the position of the weights, the mass of the weights, etc.), the club fitter can order or build a club head for the golfer having permanent weighting characteristics based on and derived from the movable and interchangeable weights and wrapping elements used during the fitting session(s).

III. Conclusion

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with the Figs. may be used individually and/or in any combination or subcombination without departing from this invention.

We claim:

1. A wood-type golf club head, comprising:

a ball striking face;

a club head body coupled to the ball striking face, the club head body having a rear portion opposite the ball striking face, a crown portion, a sole portion, a toe end portion, and a heel end portion and including a groove extending at least around the perimeter of the club head body adjacent the ball striking face wherein the perimeter adjacent the ball striking face extends around the crown portion, the sole portion, the toe end portion, and the heel end portion; and a wrapping element comprising a first portion for extending around the perimeter of the club head body adjacent to the ball striking face and engaging the groove in the golf club head body, and a second portion connected to the first portion and extending around a rear portion of the club head body.

2. A wood-type golf club head according to claim 1, wherein the second portion is connected to the first portion in at least two locations.

3. A wood-type golf club head according to claim 1, wherein the second portion engages a corresponding groove in the golf club head body.

4. A wood-type golf club head according to claim 1, wherein the club head body further comprises a hosel; wherein a portion of the wrapping element extends around the hosel.

5. A wood-type golf club head according to claim 4, wherein the portion extending around the hosel comprises a sleeve.

6. A wood-type golf club head according to claim 1, wherein the wrapping element comprises a flexible material comprising a fabric, a polymeric material, an elastic material, a stretchable material, or combinations thereof.

7. A wood-type golf club head according to claim 1, wherein at least part of the first portion of the wrapping element is weighted.

8. A wood-type golf club head according to claim 1, wherein at least part of the second portion of the wrapping element is weighted.

9. A wood-type golf club head according to claim 1, wherein the first portion is a continuous strap and is placed on the club head body by stretching the strap.

10. A wood-type golf club head according to claim 1, wherein the first portion is a discontinuous strap having two ends and is placed on the club head body by attaching the two ends together.

11. A wood-type golf club head according to claim 10, wherein the two ends are attached using a hook and loop fastener.

12. A wood-type golf club head according to claim 1, wherein the head is made from a material selected from the group consisting of: a polymeric material, a composite material, a fiber-reinforced composite material, and a light-weight metal material.

13. A wood-type golf club head comprising:

a ball striking face;

a club head body coupled to the ball striking face, the club head body including a groove extending at least around the perimeter of the club head body; and a wrapping element comprising a first portion for extending around the perimeter of the club head body adjacent to the ball striking face and engaging the groove in the club head body, wherein the club head body further comprises at least one weight receptacle, wherein the wrapping element covers the receptacle to hold a weight insert in place.

14. A wood-type golf club head according to claim 13, wherein a gasket is located in the receptacle.

15. A wood-type golf club head according to claim 13, wherein at least one weight insert is supported in at least one receptacle.

16. A wood-type golf club, comprising:

a club head comprising:

a ball striking face;

a club head body coupled to the ball striking face, the club head body having a rear portion opposite the ball striking face, a crown portion, a sole portion, a toe end portion, and a heel end portion and including a groove extending at least around the perimeter of the club head body adjacent the ball striking face wherein the perimeter adjacent the ball striking face extends around the crown portion, the sole portion, the toe end portion, and the heel end portion;

a wrapping element comprising a first portion for extending around the perimeter of the club head body adjacent to the ball striking face and engaging the groove in the golf club head body, and a second portion connected to the first portion and extending around a rear portion of the club head body; and a shaft member engaged with the club head.

17. A wood-type golf club according to claim 16, wherein a grip member is engaged with the shaft member.

18. A wood-type golf club according to claim 16, wherein the second portion is connected to the first portion in at least two locations.

19. A wood-type golf club according to claim 16, wherein the second portion corresponds to a second groove in the club head body.

20. A wood-type golf club according to claim 16, wherein the club head body further comprises a hosel; wherein a portion of the wrapping element extends around the hosel.

21. A wood-type golf club according to claim 20, wherein the portion for extending around the hosel comprises a sleeve.

22. A wood-type golf club according to claim 16, wherein the wrapping element comprises a flexible material comprising a fabric, a polymeric material, an elastic material, a stretchable material, or combinations thereof.

23. A wood-type golf club according to claim 16, wherein at least part of the first portion is weighted.

24. A wood-type golf club according to claim 16, wherein at least part of the second portion is weighted.

25. A wood-type golf club according to claim 16, wherein the first portion is a continuous strap and is placed on the club head body by stretching the strap.

26. A wood-type golf club according to claim 16, wherein the first portion is a discontinuous strap having two ends and is placed on the club head body by attaching the two ends together.

27. A wood-type golf club according to claim 26, wherein the two ends are attached using a hook and loop.

28. A wood-type golf club according to claim 16, wherein the head is made from a material selected from the group consisting of: a polymeric material, a composite material, a fiber-reinforced composite material, a light-weight metal material.

29. A wood-type golf club according to claim 16, wherein the club head body is metal.

30. A wood-type golf club comprising a club head comprising:

a ball striking face;

a club head body coupled to the ball striking face, the club head body including a groove extending at least around the perimeter of the club head body; and a wrapping element comprising a first portion for extending around the perimeter of the club head body adjacent to the ball striking face and engaging the groove in the golf club head body, wherein the golf club head further comprises at least one weight receptacle, wherein the wrapping element covers the receptacle to hold a weight insert in place.

31. A wood-type golf club according to claim 30, wherein a gasket is located in the receptacle.

32. A wood-type golf club according to claim 30, wherein at least one weight insert is supported in at least one receptacle.

* * * * *